US005833091A

United States Patent [19]

Palmer

[11] Patent Number: 5,833,091

[45] Date of Patent: Nov. 10, 1998

[54] PORTABLE SEE-THROUGH GOLF BALL DISPENSER

[76] Inventor: Richard H. Palmer, 6901 Holmes Blvd. E West, Holmes Beach, Fla. 34217

[21] Appl. No.: 723,413

[22] Filed: Sep. 30, 1996

[51] Int. Cl.[6] ..... B65G 59/06; B65H 3/30

[52] U.S. Cl. ..... 221/256; 221/266; 221/301; 224/918

[58] Field of Search ..... 294/19.2; 224/918, 224/919, 196; 221/97, 185, 199, 256, 257, 266, 281, 301

[56] References Cited

U.S. PATENT DOCUMENTS

| | | | |
|---|---|---|---|
| 3,206,067 | 9/1965 | Smith, Jr. et al. | 294/19.2 |
| 3,281,013 | 10/1966 | Motard | 294/19.2 |
| 3,984,029 | 10/1976 | Baugh | 221/256 |
| 4,088,251 | 5/1978 | Rodriguez | 221/309 |
| 4,678,108 | 7/1987 | Inman | 221/185 |
| 4,781,307 | 11/1988 | Ferro | 221/281 |
| 4,784,305 | 11/1988 | Schoenberg | 224/918 |
| 5,040,675 | 8/1991 | Cleveland et al. | 221/307 |
| 5,190,196 | 3/1993 | Hamer, III | 224/196 |

FOREIGN PATENT DOCUMENTS

| | | | |
|---|---|---|---|
| 1258660 | 8/1989 | Canada | 294/19.2 |
| 975863 | 12/1929 | France | 221/301 |
| 2529467 | 1/1984 | France | 294/19.2 |

*Primary Examiner*—Karen M. Young
*Assistant Examiner*—Thuy V. Tran
*Attorney, Agent, or Firm*—Aquilino & Welsh

[57] ABSTRACT

A golf ball dispenser formed of a plurality of transparent tubular golf ball containers attached by a mounting bridge member and a strap. A connector on the strap permits attaching the dispenser to a rigid object. Each container includes a loading opening and a dispensing opening. A pivotable golf ball dispensing cradle, located at the dispensing opening and spring biased in a normally closed position, is actuated by a lever to transport a golf ball from within the tubular container through the dispensing opening for removal by a golfer.

12 Claims, 2 Drawing Sheets

PORTABLE SEE-THROUGH GOLF BALL DISPENSER

BACKGROUND OF THE INVENTION

The present invention relates to a portable see-through golf ball dispenser and in particular to a golf ball dispenser, which is structurally adapted to be attached to a golf bag or golf cart.

Most golf bags are made with pockets for storing a plurality of golf balls, usually along with golf tees, golf green repair tools, golf gloves and the like. With this arrangement, a player must search through the ball pocket, examining individual golf balls, until a particular brand or number is found suitable for playing a particular round of golf. This can be a time consuming process and often causes disruption in the playing of the game of golf, particularly when a golfer needs additional golf balls while playing a round of golf.

There have been attempts in the prior art to provide golf ball dispensers in combination with golf bags. For example, the patents to Conner, U.S. Pat. No. 1,699,048, Hollins, U.S. Pat. No. 1,829,093 and Gielow, U.S. Pat. No. 2,664,933 all show golf bags with elongated tubular dispensers for carrying and dispensing individual golf balls. All of these patents have shortcomings.

Specifically, the golf ball dispensers are rigidly and non-movably attached to the golf bag. The dispensers do not allow a golfer to view the next golf ball to be dispensed and none of these dispensers permit controlling the number of balls being dispensed except by manually limiting the movement of the ball. For example, in the Conner patent, the golf balls are not in sight so that no prior choice can be made. When a ball is to be dispensed, the golfer must stoop down and open a lower door whereby the balls fall out until they are stopped by the golfer closing the door. Similar structures are shown in the Hollins and Gielow patents.

SUMMARY OF THE INVENTION

The present invention provides a golf ball dispenser which overcomes the shortcoming of the prior art devices. The golf ball dispenser is portable and includes a strap having a suitable closure, permitting the dispenser to be attached to a golf bag or to a golf cart, either a pull cart or a motor operated cart. The dispenser includes a pair of tubular transparent dispensing containers, allowing the player to view the golf balls within the dispensing containers, allowing the golfer to preselect a particular ball of his choice. The ball is dispensed by actuating a simple cradle mechanism which is spring loaded in a normally closed position to maintain the ball within the dispenser container. Upon actuation of the cradle, it pivots against the resistance of the spring, carrying a single ball from the interior of the dispenser container, and moving it outwardly thereof, permitting easy access to the golfer. The cradle includes a cam-shaped retaining surface which engages the lowermost golf ball remaining in the tubular container, thereby keeping it in position until the cradle is returned to its normally closed position. The cradle includes an extraction lever which is easily operated by the finger of a golfer enabling the cradle to be pivoted downwardly to present the ball to the player. The ball may be returned to the interior of the container as long as it rests in the cradle. Alternately, it may be removed from the container and placed back into the container through a top opening structure.

Preferably, the dispensers are attached to a rigid cross-brace which also includes a holder for golf tees. An additional feature of the dispenser is the use of a resilient diaphragm attached to the top opening of the tubular container. The diaphragm includes an opening slightly smaller than the diameter of a golf ball whereby a ball may be inserted through the resilient diaphragm which stretches the opening permitting a ball to pass through into the container using a small amount of downward pressure. The diaphragm then assumes its relaxed position and prevents the golf ball from being jostled or otherwise ejected from the container through the top opening.

Among the objects of the presents invention are the provision of a portable golf ball dispenser permitting easy access to a specifically selected golf ball.

Another object of the present invention is to provide a golf ball dispenser which is portable in nature and which may be attached to a golf bag or to a golf cart.

Still another object of the present invention is the provision of a golf ball dispenser which allows a single ball to be selectively dispensed while maintaining the other balls in a confined position within the dispensing container.

These and other objects of the present invention will become apparent in the following description of the preferred embodiment taken in conjunction with the accompanying drawings which are incorporated in and constitute a part of the specification thereby serving to explain the principles of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely are a basis for the claims and a basis for teaching one skilled in the art how to make and/or use the invention.

Figure 1:
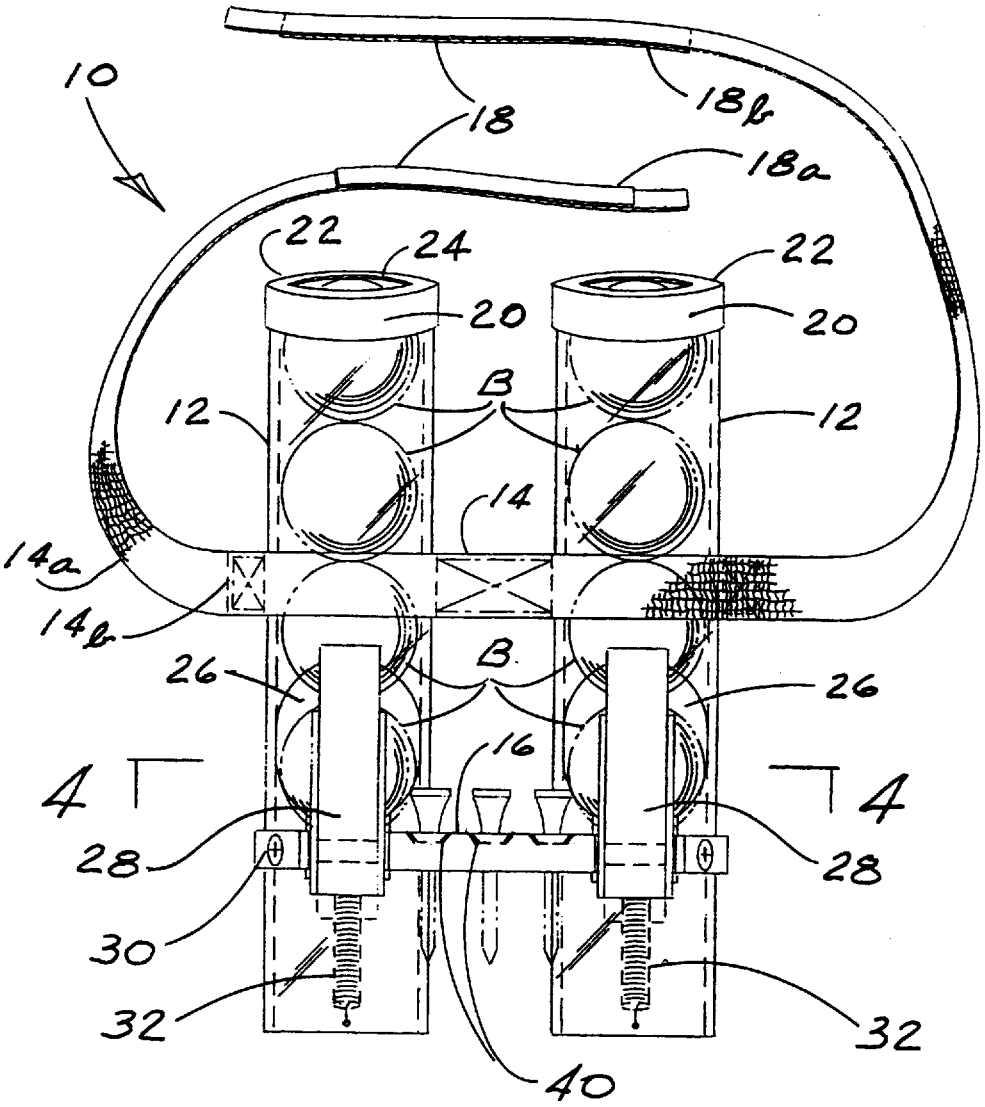
FIG. 1 is a front elevational view of a golf ball dispenser in accordance with the present invention.
Figure 4:
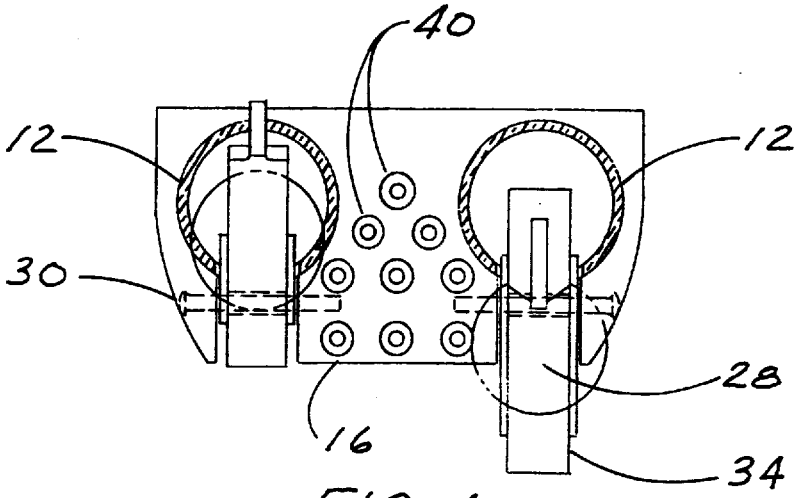
FIG. 4 is a top sectional view of the dispenser of the present invention taken along the lines 4—4 of FIG. 1.
Figures 2, 3:
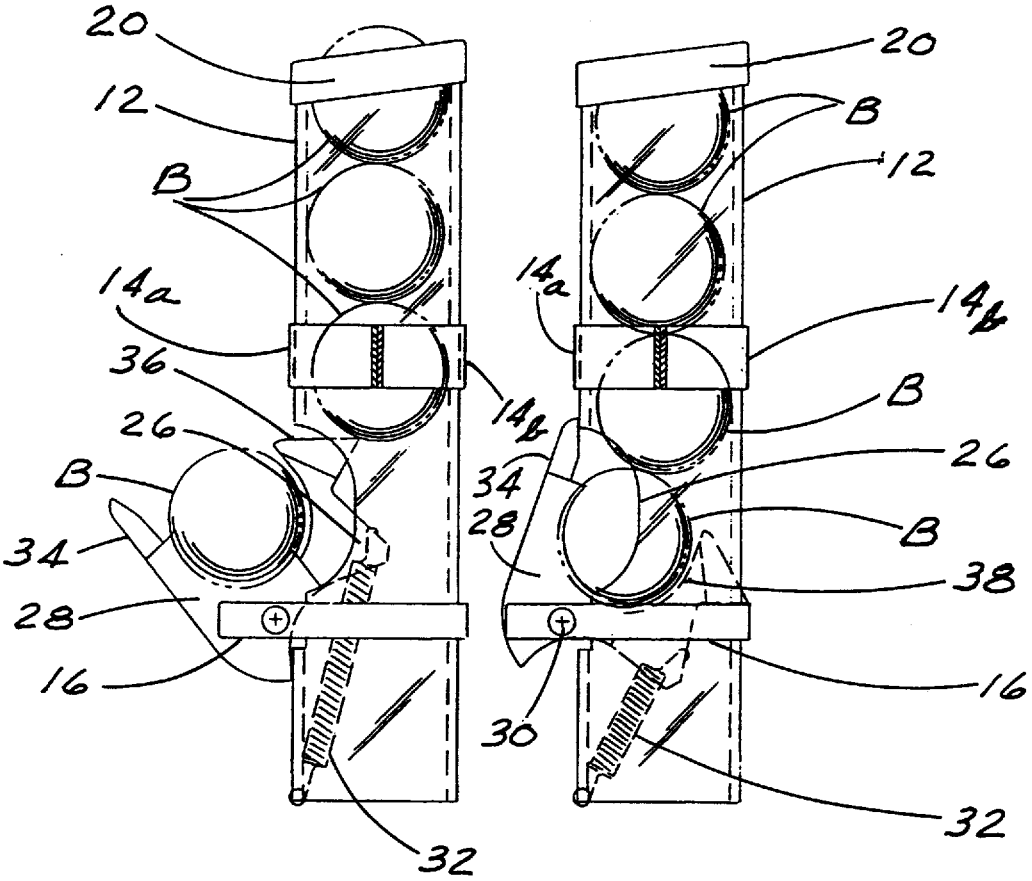
FIG. 2 is a side elevational view of a single tubular dispenser used with present invention with the dispensing mechanism in an open position.
FIG. 3 is a partial side elevational view of single dispensing tube of the present invention with the dispensing mechanism in a closed position.

FIGS. 1–4 show an embodiment of a portable golf ball dispenser 10 in accordance with the present invention. The golf ball dispenser 10 of the present invention includes a pair of tubular containers 12 connected together by a strap 14 and a rigid plastic bridge 16. The strap 14 includes a pair of loops 14*a* and 14*b* which snugly fits around the tubular containers 12. The end of the strap 14 is provided with a suitable separable fastener 18 or the like, preferably a hook and loop type separable fastener, including hook material 18*a* and complementary pile material 18*b* forming the closure.

Preferably the inner diameter of the tubular containers 12 are sized to receive golf balls enabling the balls to drop vertically by gravity during the loading operation as described hereinbelow. The top of each tubular container 12 is formed with a collar 20, including a diaphragm 22 having an opening 24 with a diameter slightly less than the diameter of a golf ball. The diaphragm 22 is made of resilient material such as plastic or rubber enabling a ball to be pushed through the opening 24 into the tubular container 12 using a slight downward pressure in order to load the dispenser. Each tubular container 12 is made of transparent plastic material so that the golf balls inside may be viewed and identified by the golfer, enabling a particular brand, number or even color of golf ball to be selected by the golfer. The bottom of each tubular container 12 includes a dispensing opening 26. Each tubular container 12 is provided with a cradle 28 pivotally mounted at the opening 26 on a elongated pin 30 which passes through each cradle 28 and the plastic bridge 16. The ends of the pin 30 preferably are threaded (not shown) and secured by a suitable cap nut. Each cradle 28 is attached to a spring 32 which pivots the cradle 28 to a normally closed position, into the dispensing opening 26 where it engages a single golf ball B in a semi-circular socket 38 having a diameter slightly larger than the diameter of a golf ball being dispensed. The outer end of the cradle 28 is provided with an extractor lever 34 designed to be operated by the finger of a golfer during the dispensing process. The opposite end of the cradle 28 includes a cam shaped retaining surface 36 which is used to retain any golf balls remaining in the tubular container 12 in position until the dispensing process in complete.

The bridge 16 connecting the tubular container is provided with a series of bores 40 which are sized to mount a plurality of golf tees T adjacent the dispenser containers 12 to be readily available to the golfer.

In use, the golf ball dispenser 10 is attached to a golf bag or a golf cart by the strap 14 and secured with the hook and loop separable fastener 18. Golf balls are loaded through the opening in diaphragm 24 on the collar 20 into the transparent tubular containers 12. It will be appreciated that the containers 12 may be of any suitable length to accommodate a number of golf balls. This preferred embodiment houses four (4) golf balls in each container 12, but as many as six (6), eight (8), or more balls may be accommodated. Similarly any number of containers 12 may be provided in a dispenser. The golf balls stored within the transparent tubular containers 12, may be easily identified by the golfer as to brand, number or type, by simply viewing the ball through the transparent plastic material that forms the container. With the tubular container 12 loaded with golf balls, and with the cradle 28 in the normally closed position, the lowermost ball rests in the socket 38 of the cradle 28. When a golfer wishes to retrieve a ball from a container 12, he or she operates the extractor level 34 to pivot the cradle 28 outwardly, carrying the lowermost ball with it through the opening 26 so that it may be removed by the golfer. Simultaneously, the cam shaped retaining surface 36 engages the next golf ball stored within the container 12 keeping it in a raised position until the cradle 28 is returned by the spring 32 to its closed position. At that time, the next ball drops into the socket 38 making it available for the golfer upon repeating the dispensing process.

It will be appreciated that the golfer may dispense any number of balls until a particular ball located within the transparent container is removed. Any ball dispensed which is not immediately used may be replaced back into the container through the diaphragm 22 in the collar 20.

Thus, it can be seen that the dispensing operation is quick and efficient enabling a golfer to obtain the exact golf ball he or she wishes to use with a minimum amount of effort, eliminating fumbling through dozens of golf balls inside a dark zippered golf bag to obtain a particular desired ball. It will also be appreciated that golf tees are easily removed from the counter sunk bores 40 in the bridge 16 for use by the golfer.

While a preferred embodiment has been shown and described, it will be understood that there is no intent to limit the invention by such disclosure, but rather, it is intended to cover all modifications and alternate constructions falling within the spirit and scope of the invention as defined in the appended claims.

I claim:

1. A ball dispenser for dispensing a plurality of balls, one at a time, comprising:

a plurality of elongated, tubular dispenser containers structured to receive a plurality of balls;

a bridge connecting each of said tubular dispenser containers;

said tubular dispenser containers each being defined by a loading opening and a dispensing opening; means for dispensing one of said plurality of balls attached to each of said containers;

said means for dispensing including a cradle-shaped member pivotally attached to each of said containers at said dispensing opening and pivotally movable into and out of said opening;

said cradle-shaped member being attached to said container and to said bridge by a mounting pin connected to said cradle-shaped member and said bridge;

said cradle including a socket for holding one of said balls during said dispensing operation;

said cradle further including an actuator lever structured to be engaged by a user, whereby actuation of said lever pivotally moves said cradle from a normally closed position to an open position at said dispensing opening, said cradle carrying one of said balls therewith;

said cradle further including a retainer means formed thereon for retaining other balls in said tubular container away from said dispensing means during a dispensing operation.

2. The dispenser of claim 1 further including a resilient biasing means for biasing said cradle in a closed position.

3. The dispenser of claim 2 wherein said resilient means is a spring.

4. A dispenser of claim 1 further including a strap attached to said dispenser for securing said dispenser to a rigid object.

5. The dispenser of claim 4 wherein said strap includes means for engaging said tubular container.

6. The dispenser of claim 5 wherein said means for engaging said tubular container is a loop formed in said strap.

7. The dispenser of claim 4 wherein said strap includes a separable fastener means for securing said strap to said rigid object.

8. A dispenser of claim 1 further including a collar on said loading opening of said container.

9. The dispenser of claim 9 wherein said collar includes a resilient diaphragm having an opening with a slightly smaller diameter than a diameter of said balls whereby said balls may be loaded through said diaphragm opening by exerting a force and wherein said diaphragm opening prevents the balls from escaping once they are position within said container.

10. The dispenser of claim 1 further including means on said bridge for storing a plurality of golf tees.

11. The dispenser of claim 1 wherein said balls are golf balls.

12. The dispenser of claim 1 wherein said elongated tubular container is made of transparent material.

* * * * *